US008133579B2

(12) United States Patent
Mennig et al.

(10) Patent No.: US 8,133,579 B2
(45) Date of Patent: Mar. 13, 2012

(54) ULTRA-HARD COMPOSITE LAYERS ON METAL SURFACES AND METHOD FOR PRODUCING THE SAME

(75) Inventors: Martin Mennig, Quierschied (DE); Helmut Schmidt, Saarbruecken-Guedingen (DE)

(73) Assignee: EPG (Engineered Nanoproducts Germany) AG, Griesheim (DE)

( * ) Notice: Subject to any disclaimer, the term of this patent is extended or adjusted under 35 U.S.C. 154(b) by 0 days.

(21) Appl. No.: 12/666,540

(22) PCT Filed: Jun. 26, 2008

(86) PCT No.: PCT/EP2008/058132

§ 371 (c)(1),
(2), (4) Date: Mar. 3, 2010

(87) PCT Pub. No.: WO2009/000874

PCT Pub. Date: Dec. 31, 2008

(65) Prior Publication Data

US 2010/0178491 A1 Jul. 15, 2010

(30) Foreign Application Priority Data

Jun. 27, 2007 (DE) ..... 10 2007 029 668

(51) Int. Cl.
*B32B 7/02* (2006.01)
*B05D 3/02* (2006.01)

(52) U.S. Cl. ..... 428/330; 428/145; 428/325; 427/226; 427/316; 427/376.2; 427/387; 427/397.7; 427/402; 427/557

(58) Field of Classification Search ..... 428/320.2, 428/322.7, 323, 325, 688, 689, 698, 145, 428/327, 330; 427/226, 316, 376.2, 387, 427/397.7, 402, 553, 557
See application file for complete search history.

(56) References Cited

U.S. PATENT DOCUMENTS

| | | | | |
|---|---|---|---|---|
| 6,162,498 | A * | 12/2000 | Mennig et al. | 427/226 |
| 6,749,945 | B2 * | 6/2004 | Knobbe et al. | 428/450 |
| 6,855,396 | B1 * | 2/2005 | Mennig et al. | 428/144 |
| 2007/0089642 | A1 | 4/2007 | Engler et al. | |
| 2008/0118745 | A1 | 5/2008 | Endres et al. | |
| 2010/0098956 | A1 | 4/2010 | Sepeur et al. | |

FOREIGN PATENT DOCUMENTS

| | | | |
|---|---|---|---|
| DE | 102004001097 | A1 | 7/2005 |
| DE | 102006040385 | A1 | 1/2007 |
| DE | 102005050593 | A1 | 4/2007 |
| DE | 102005059614 | A1 | 6/2007 |
| WO | 2005/066388 | A2 | 7/2005 |

OTHER PUBLICATIONS

English language abstract of DE 102006040385 A1.
Ullmanns Encyclopädie der technischen Chemie, 4th edition, vol. 20, "Schleifen and Schleifmittel", pp. 449-455.
Ullmanns Encyclopädie der technischen Chemie, 4th edition, vol. 12, "Hartstoffe (Einteilung)", pp. 523-524.

* cited by examiner

*Primary Examiner* — Cathy Lam
(74) *Attorney, Agent, or Firm* — Abel Law Group, LLP

(57) ABSTRACT

The invention relates to a metal substrate comprising an ultra-hard composite layer consisting of an inorganic, vitreous matrix containing one or more abrasive fillers. According to the invention, the diameter of the filler particles or, if the filler particles have a platelet-type form, the thickness of the filler particles is less than the layer thickness of the composite layer.

22 Claims, No Drawings

ULTRA-HARD COMPOSITE LAYERS ON METAL SURFACES AND METHOD FOR PRODUCING THE SAME

BACKGROUND OF THE INVENTION

1. Field of the Invention

The present invention relates to metal substrates having an ultra-hard composite layer thereon.

2. Discussion of Background Information

Metal surfaces, with the exception of hard metals or specially hardened metals, are generally relatively soft compared to ceramic materials. They are therefore very sensitive toward abrasive media or abrasives. This means that metal surfaces, particularly when they are polished, are very sensitive toward cleaners, steel wool but also other articles which have a tendency to scratch, for example zips or office clips. The metal surfaces then very quickly lose their attractive surface and become matt and unsightly.

However, hardened metal surfaces are also important in other fields. For instance, chromium-hardened steel surfaces are used in machine construction and in the automotive sector in order to harden, for example, pistons or piston rods, cylinder liners and many other surfaces which are subject to wear in order to avoid or reduce wear and thus increase the life. In other processes, the surfaces are, for example, hardened by nitridation or carburization, in which case the diffusion of nitrogen or carbon into the surface produces nitrides or carbides.

The deposition of nitrides or carbides by CVD processes (e.g. TiN, ZrN, vitreous carbon) also enables hard layers to be applied to surfaces. These layers are generally very thin and the associated processes have only limited suitability for large areas and/or complex geometries. In addition, only a very limited number of colors can be produced by CVD processes.

PVD processes are also used for surface layers. In general, these layers are not particularly mechanically and chemically stable due to the usually columnar growth mode.

Ceramic layers can be applied to metal surfaces by flame or plasma spraying processes. These layers are up to several 100 μm thick, are usually very abrasion-resistant, but are usually not transparent and very brittle and usually not resistant to thermal shock.

Thin, transparent layers based on sol-gel systems and nanosize systems can be produced by wet coating processes. DE-A-102004001097 (corresponding to WO-A-2005066388) describes a coating technology by means of which layers having a thickness of only a few μm can be obtained on metal surfaces. Despite this low thickness, the layers are very abrasion-resistant and cannot be scratched by means of, for example, α-alumina-containing scouring sponges. However, they may suffer massive damage when subjected to prolonged action of milling media and scourers based on α-alumina or silicon carbide.

It is an object of the present invention to provide a transparent, translucent or colored coating system for metal surfaces which does not have the above-mentioned deficiencies. It should, in particular, have an extraordinarily high abrasion resistance compared to the known systems and be able to be applied by a wet-chemical coating process. In addition, it should be made possible not only to form an ultrahard protective layer but also give the metal substrate any color.

The object has surprisingly been able to be achieved by a coating composition which comprises precursors for an inorganic, vitreous matrix and fine, highly abrasion-resistant fillers being applied to a metal surface of a substrate and thermally densified, the particle size of the abrasive fillers used being smaller than the thickness of the layer obtained.

SUMMARY OF THE INVENTION

The present invention provides a metal substrate having a composite layer thereon. The composite layer is an ultrahard composite layer comprised of an inorganic, vitreous matrix which comprises at least one abrasive filler. The diameter of the filler particles or, in the case of a platelet geometry of the filler particles, the thickness of the filler particles is less than the thickness of the composite layer.

In one aspect, the at least one abrasive filler may comprise a filler which is composed of a hard material.

In another aspect, the inorganic, vitreous matrix may comprise an alkaline earth metal silicate and/or an alkali metal silicate.

In yet another aspect, the at least one abrasive filler may comprise at least one substance selected from carbides, nitrides and borides of transition metals, natural and synthetic diamond, α-alumina, natural and synthetic precious stones, boron, boron nitride, boron carbide, silicon carbide, silicon nitride, and platelet-like $Al_2O_3$. For example, the at least one abrasive filler may comprise at least one substance selected from α-alumina, silicon carbide and tungsten carbide.

In a still further aspect, the diameter of the filler particles or, in the case of a platelet geometry of the filler particles, the thickness of the filler particles may be smaller than the thickness of the composite layer by a factor of at least 5.

In another aspect, the thickness of the composite layer may be not greater than 20 μm and/or the proportion of the at least one abrasive filler in the composite layer may be from 1% to 35% by weight, based on a total weight of the finished composite layer.

In another aspect, the inorganic, vitreous matrix may comprise at least one platelet-shaped abrasive filler and at least one abrasive filler which is not platelet-shaped.

In another aspect, one or more intermediate layers may be arranged between the metal substrate and the ultrahard composite layer.

In yet another aspect, at least one pigment selected from color-imparting pigments and effect pigments may be present in the composite layer or in an intermediate layer which may be arranged between the composite layer and the metal substrate.

The present invention also provides a process for producing a metal substrate having an ultrahard composite layer. The process comprises applying a coating composition comprising a hydrolyzate and/or condensate of a hydrolyzable compound as glass-forming matrix precursor and at least one abrasive filler to a metal substrate and thermally densifying the coating composition to form the composite layer. The diameter of the filler particles or, in the case of a platelet geometry of the filler particles, the thickness of the filler particles in the coating composition is smaller than the thickness of the composite layer.

In one aspect of the process, the hydrolyzate and/or condensate may comprise a sol comprising an alkali metal silicate and/or an alkaline earth metal silicate.

In another aspect, the sol may be obtained by hydrolysis and condensation of one or more silanes of formula (I)

$$R_nSiX_{4-n} \quad (I)$$

wherein the groups X are identical or different and represent hydrolyzable groups or hydroxyl groups, the radicals R are identical or different and represent hydrogen, alkyl, alkenyl and alkynyl groups having up to 4 carbon atoms and aryl, aralkyl and alkaryl groups having from 6 to 10 carbon atoms, and n is 0, 1 or 2, with the proviso that at least one silane having n=1 or 2 is used, or oligomers derived therefrom, in the presence of at least one compound selected from oxides and hydroxides of alkali metals and alkaline earth metals.

In yet another aspect of the process, additional hydrolyzable compounds which do not contain Si may be used in addition to the silanes of formula (I).

In a still further aspect, nanosize $SiO_2$ particles may be added before the hydrolysis and condensation.

In another aspect of the process of the present invention, the alkali metal and/or alkaline earth metal oxides and/or hydroxides may be used in such an amount that an atomic ratio of Si:alkali metal and/or alkaline earth metal is from 20:1 to 7:1.

In another aspect, the average value of n in the starting silanes of formula (I) may be from 0.2 to 1.5.

In another aspect, the coating composition may further comprise an organic solvent and/or water.

In yet another aspect, the coating composition applied to the metal substrate may be densified at a temperature of from 350° C. to 700° C., e.g., at a temperature of from 300° C. to 800° C.

In another aspect, the coating composition may be densified in one or more stages and/or under atmospheric or oxidizing, inert or reducing conditions or under such successively changing conditions.

The present invention also provides an article which comprises the coated metal substrate of the present invention as set forth above (including the various aspects thereof). The article is selected from metal housings of electronic instruments, metallic components for optical instruments, metallic parts of interiors and exteriors of vehicles, metallic components in machine and plant construction, engines, metallic components involved in medical instruments, metallic components of household appliances, electric appliances, sports equipment, weapons, munitions and turbines, household equipment, metallic façade components, metallic components of elevators, parts of conveying devices, metallic parts of furniture, garden equipment, agricultural machinery, mountings, engine components, and production plants.

These composite layers surprisingly have a tremendously high scratch and abrasion resistance, so that they can be described as ultrahard layers. Since the composite layer can be applied by wet chemical means, production of the layer is also simple and economical and it is also possible to provide metal substrates having a complex geometry with the composite layer. Since the composite layer can also be produced in transparent form and intermediate layers can be inserted between the metal substrate and the composite layer, color effects can be produced as required by incorporation of appropriate color-imparting agents into the composite layer itself or into an intermediate layer. In addition, the layers can be very thin.

The best results have been achieved when using the coating compositions described in DE-A-102004001097 for formation of the inorganic, vitreous matrix. The processes described there for thermal densification of the layer have also been found to be advantageous. The coating compositions described there for the inorganic, vitreous matrix and the process steps for thermal densification are therefore hereby incorporated by reference. The invention is explained in detail below.

As metal substrate to be coated according to the invention or metallic surface to be coated according to the invention, it is possible to use all surfaces consisting of a metal or a metal alloy or comprising this or these, e.g. substrates composed of another material which is provided on at least one surface with a metal layer. For the purposes of the present patent application, the term metal always includes metal alloys. The metal substrate can be, for example, semifinished parts such as plates, metal sheets, tubes, rods or wires, components or finished products. The metal substrate can be provided with the composite layer over the entire metal surface. It is naturally also possible to provide only individual regions or parts of the metal surface with the composite layer when, for example, only particular regions require corresponding protection.

Examples of suitable metals for the metal substrate are aluminum, titanium, tin, zinc, copper, chromium or nickel, including zinc-plated, chromium-plated or enameled surfaces. Examples of metal alloys are, in particular, steel or stainless steel, aluminum alloys, magnesium alloys and copper alloys such as brass and bronze. Particular preference is given to using metallic surfaces composed of steel, stainless steel, zinc-plated, chromium-plated or enameled steel or titanium.

The metallic surface or the metallic substrate can have a flat or structured surface. The geometry of the metal substrate can be simple, e.g. a simple metal sheet, or complex, e.g. provided with edges, rounding, raised regions or depressions. The metallic surface is preferably cleaned and freed of grease and dust before application of the coating composition. A surface treatment, e.g. by means of a corona discharge, can also be carried out before coating.

The fully hardened composite layer comprises an inorganic, vitreous matrix which contains one or more abrasive fillers. The layer is therefore a composite composed of the matrix and the filler, preferably a filler composed of hard material.

The filler is composed of an abrasive material, in particular a highly abrasion-resistant or highly abrasive material. Such materials are known to those skilled in the art and are used, for example, as grinding abrasives. The abrasive fillers used preferably have, based on the Mohs' hardness scale, a Mohs' hardness of at least 7 and preferably >7. The abrasive filler or fillers used are preferably fillers composed of a hard material. Hard materials are generally known to those skilled in the art, are commercially available and are used, for example, in the cemented carbide and abrasives industries. A general overview and examples of abrasive materials or hard materials which are suitable for the purposes of the invention may be found, for example, in Ullmanns Encyclopädie der technischen Chemie, 4th edition, vol. 20, "Schleifen and Schleifmittel", pp. 449-455, and vol. 12, "Hartstoffe (Einteilung)", pp. 523-524, Verlag Chemie, Weinheim N.Y., 1976.

Abrasive materials, in particular hard materials are characterized by their high hardness. Many different materials are known as abrasive materials or hard materials, in particular as grinding abrasives, which can all be used for the purposes of the present invention. It is possible to use metallic or nonmetallic abrasive fillers or hard materials, with nonmetallic materials being preferred. In a preferred embodiment, transparent abrasive fillers are used. It is possible to use one abrasive filler or mixtures of two or more abrasive fillers. It is also possible to use mixtures of abrasive fillers which are composed of the same material but differ, for example, in terms of size and/or particle shape, naturally also, if appropriate, with abrasive fillers composed of other materials.

Examples of hard materials are carbides, nitrides, borides, oxycarbides or oxynitrides of transition metals or semimetals, for example of Si, Ti, Ta, W and Mo, e.g. TiC, WC, TiN, TaN, $TiB_2$, $MoSi_2$, hard material mixed crystals, such as TiC-WC or TiC—TiN, double carbides and complex carbides such as $CO_3W_3C$ and $Ni_3W_3C$ and intermediate compounds, e.g. from the systems W—Co or Mo—Be, natural or synthetic diamond, α-alumina ($Al_2O_3$), e.g. emery, fused aluminas or sintered aluminas, natural or synthetic precious stones such as sapphire, ruby or zircon, boron, cubic boron nitride, boron carbide ($B_4C$), silicon carbide (SiC) and silicon nitride ($Si_3N_4$), quartz, glass or glass powder. Examples of abrasion-resistant fillers which can be used are platelet-like $Al_2O_3$, platelet-like $SiO_2$, $TiO_2$ and the like.

Hard materials which are preferably used are carbides, nitrides or borides of transition metals, natural or synthetic diamond, α-alumina and platelet-like α-alumina, natural or synthetic precious stones, boron, boron nitride, boron carbide, silicon carbide, silicon nitride and aluminum nitride, with the nonmetallic materials being preferred. Particularly suitable hard materials are α-alumina, silicon carbide and tungsten carbide.

The amount of abrasive filler used in the composite layer can vary within a wide range depending on the intended use. However, preferred results can generally be achieved when the proportion of abrasive filler in the composite layer is in the range from 1 to 10% by weight, preferably from 1 to 5% by weight and particularly preferably from 1.5 to 3% by weight, based on the total weight of the finished composite layer.

The fillers are particulate. The particles can have any shape. They can, for example, be spherical, block-shaped or platelet-like. A person skilled in the art will know that the particles can frequently have a more or less irregular shape, e.g. when they are present as aggregates. If no preferential directions are present, the shape of a sphere is frequently assumed for size determination. In the case of platelet- or flake-like particles, two preferential directions are present.

In a preferred embodiment of the invention, at least one abrasive filler, preferably one abrasive filler, has a platelet-like geometry; an example is platelet-shaped α-alumina. In a further preferred embodiment of the invention, use is made of at least one abrasive filler having a platelet-like geometry and an abrasive filler which does not have a platelet-like geometry, e.g. particles without a preferential direction, e.g. a mixture of platelet-shaped α-alumina and abrasive-blasting alumina. If platelet-like abrasive fillers and abrasive fillers which are not platelet-like are used, the weight ratio of the platelet-like abrasive filler to the abrasive filler which is not platelet-like in the layer is preferably in the range from 1 to 10, more preferably from 1.5 to 5 and more preferably from 2 to 3.

The finished composite layer after thermal densification can, for example, have a thickness of up to 20 μm, preferably up to 10 μm and particularly preferably up to 4 μm, without crack formation occurring during drying and during densification. In general, the layer thickness is at least 1 μm, preferably at least 2 μm. The thickness of the composite layer can be, for example, in the range from 3 to 8 μm.

To achieve an appropriate effect, the particle size of the filler composed of hard material used is smaller than the thickness of the composite layer obtained after thermal densification. The particle size is preferably significantly smaller than the thickness of the composite layer, e.g. the particle size is smaller by a factor of at least 2 and preferably smaller by a factor of at least 5 (i.e. the particle size is preferably less than ½, preferably less than ⅕, of the layer thickness).

In the case of particles which are not platelet-like, i.e. particularly particles without preferential directions, the particle size is the diameter. Here, the diameter is the average particle diameter based on the volume average ($d_{50}$). This value can be determined, for example, by dynamic laser light scattering, e.g. using a UPA (ultrafine particle analyzer, Leeds Northrup).

It has surprisingly been found when using platelet-like abrasive fillers, in particular ones composed of hard material, that in the case of these platelet-like particles the relevant particle size is not the diameter of the particles but the thickness of the platelets. For this reason, in the case of platelet-like filler particles, only the thickness of the platelets has to be smaller, preferably significantly smaller, than the thickness of the composite layer. The diameter based on the two preferential directions is not critical and can even be larger than the layer thickness. Since the thickness of the platelets is inherently significantly smaller than the diameter, platelets having a relatively large diameter can therefore be used.

The particle sizes of platelet-like particles, i.e. the thickness and diameter, can be determined, for example, by means of optical microscopy using optical image analysis. Since the particles are platelet-like particles, the diameter is the lateral diameter or the equivalent diameter of the projected equivalent-area circle in a stable particle position. Here too, thickness and diameter are the average thickness or the average diameter, based on the volume average ($d_{50}$).

Since platelet-like abrasive fillers, e.g. platelet-shaped α-alumina, give particularly good results, the use of at least one platelet-like abrasive filler, in particular one composed of hard material, is preferred. The thickness of the platelets is preferably less than 1 μm. Preference is given to using platelet-like fillers having a thickness of from 0.100 to 0.3 μm, with the diameter being able to be from about 3 to 10 μm. Particularly preferred platelet-like fillers have a thickness in the region of about 0.2 microns and a platelet diameter in the range from about 3 to 7 μm. Very smooth surfaces are then also achieved for layers having thicknesses of a few μm.

The composite layer comprises an inorganic, vitreous matrix. The combination of this matrix with the fillers used according to the invention, as explained above, present therein surprisingly gives an ultrahard layer. The matrix preferably comprises an alkaline earth metal silicate and/or alkali metal silicate. The production of such inorganic, vitreous matrices or matrices containing alkaline earth metal silicate and/or alkali metal silicate is known to those skilled in the art. The matrix is particularly preferably a matrix produced by the process and using the materials as described in DE-A-102004001097.

To produce the composite layer, a coating composition comprising a hydrolyzate or condensate of a hydrolyzable compound as glass-forming matrix precursor and one or more abrasive fillers, preferably fillers composed of a hard material, is applied to a metal substrate and thermally densified to form the composite layer, where the diameter of the filler particles or, in the case of a platelet-like geometry of the filler particles, the thickness of the filler particles in the coating composition is smaller than the thickness of the composite layer. This means that the composite layer is applied by wet-chemical means.

The hydrolyzate or condensate of hydrolyzable compounds is preferably a coating suspension or solution, particularly preferably a coating sol, which is preferably produced by the sol-gel process or similar hydrolysis and condensation processes.

The hydrolyzable compounds preferably comprise at least one organically modified hydrolyzable silane. The hydrolyzate or condensate is particularly preferably a coating suspension or solution containing alkali metal silicate or alkaline earth metal silicate and preferably a coating sol containing alkaline earth metal silicate or alkali metal silicate.

As coating suspension or solution containing alkali metal silicate or alkaline earth metal silicate, preference is given to using a coating composition which is obtained by hydrolysis and condensation of at least one organically modified hydrolyzable silane in the presence of alkali metal or alkaline earth metal oxides or hydroxides and, if appropriate, nanosize $SiO_2$ particles.

Such a coating composition can be obtained, for example, by hydrolysis and condensation of one or more silanes of the general formula (I)

$$R_nSiX_{4-n} \quad (I)$$

where the groups X are identical or different and are hydrolyzable groups or hydroxyl groups, the radicals R are identical or different and are hydrogen, alkyl, alkenyl and alkynyl groups having up to 4 carbon atoms and aryl, aralkyl and alkaryl groups having from 6 to 10 carbon atoms and n is 0, 1 or 2, with the proviso that at least one silane having n=1 or 2 is used, or oligomers derived therefrom in the presence of at least one compound from the group consisting of oxides and hydroxides of the alkali metals and alkaline earth metals, with nanosize $SiO_2$ particles being added if appropriate.

The above silanes of the formula (I) include at least one silane in whose general formula n is 1 or 2. In general, at least two silanes of the general formula (I) are used in combination, with preference being given to using at least one silane of the formula (I) in which n=0 and at least one silane of the formula (I) in which n=1 or 2. In this case, the silanes are preferably used in such a ratio that the average value of n (on a molar basis) is from 0.2 to 1.5, preferably from 0.5 to 1.0. Particular preference is given to an average value of n in the range from 0.6 to 0.8.

In the general formula (I), the groups X, which are identical or different, are hydrolyzable groups or hydroxyl groups. Specific examples of hydrolyzable groups X are halogen atoms (in particular chlorine and bromine), alkoxy groups and acyloxy groups having up to 6 carbon atoms. Particular preference is given to alkoxy groups, in particular $C_{1-4}$-alkoxy groups such as methoxy, ethoxy, n-propoxy and i-propoxy. The groups X in one silane are preferably identical, with particular preference being given to using methoxy groups and in particular ethoxy groups.

The groups R in the general formula (I), which in the case of n=2 can be the same or different, are, for example, hydrogen, alkyl, alkenyl and alkynyl groups having up to 4 carbon atoms and aryl, aralkyl and alkaryl groups having from 6 to 10 carbon atoms. Specific examples of such groups are methyl, ethyl, n-propyl, i-propyl, n-butyl, sec-butyl and tert-butyl, vinyl, allyl and propargyl, phenyl, tolyl and benzyl. The groups can have customary substituents, but such groups preferably do not bear any substituent. Preferred groups R are alkyl groups having from 1 to 4 carbon atoms, preferably methyl and ethyl, and also phenyl.

Preference is given to using at least one alkyltrialkoxysilane of the formula (I), in particular methyltriethoxysilane (MTEOS), methyltrimethoxysilane, ethyltrimethoxy-silane and ethyltriethoxysilane. Preference is given to additionally using at least one tetraalkoxysilane, in particular tetraethoxysilane (TEOS) and tetramethoxysilane.

According to the invention, preference is given to using at least two silanes of the general formula (I) in one of which n=0 and in the other n=1. Such silane mixtures comprise, for example, at least one alkyltrialkoxysilane (e.g. (m)ethyltri(m)ethoxy-silane) and a tetraalkoxysilane (e.g. tetra(m)ethoxysilane) which are preferably used in such a ratio that the average value of n is in the above-mentioned preferred ranges. A particularly preferred combination of starting silanes of the formula (I) is methyltri(m)ethoxysilane and tetra(m)ethoxysilane. (M)ethoxy and (m)ethyl are methoxy or ethoxy and methyl or ethyl, respectively.

The hydrolysis and condensation or polycondensation of the silane or silanes of the formula (I) is carried out in the presence of at least one compound from the group consisting of oxides and hydroxides of the alkali metals and alkaline earth metals. These oxides and hydroxides are preferably those of Li, Na, K, Mg, Ca and/or Ba. Examples are $Li_2O$, LiOH, $Na_2O$, NaOH, KOH, $Mg(OH)_2$, CaO, $Ca(OH)_2$, CaO, $Ca(OH)_2$, BaO and $Ba(OH)_2$, with the hydroxides being preferred.

Preference is given to using hydroxides or oxides of the alkali metals, preferably of Na and/or K, in particular NaOH and KOH. When an alkali metal oxide or hydroxide is used, it is preferably used in such an amount that the atomic ratio of Si:alkali metal is in the range from 20:1 to 7:1, in particular from 15:1 to 10:1, with the Si content of nanosize $SiO_2$ particles, if used, being taken into account. In any case, the atomic ratio of silicon to alkaline earth metal and/or alkali metal is selected such that it is sufficiently high for the resulting coating not to be soluble in water (as, for example, in the case of water glass).

The nanosize $SiO_2$ particles which may be used in addition to the hydrolyzable silanes of the general formula (I) are preferably used in such an amount that the ratio of all Si atoms in the silanes of the general formula (I) to all Si atoms in the nanosize $SiO_2$ particles is in the range from 5:1 to 1:2, in particular from 3:1 to 1:1.

For the purposes of the present invention, nanosize $SiO_2$ particles are $SiO_2$ particles having an average particle diameter based on the volume average ($d_{50}$) of preferably not more than 100 nm, more preferably not more than 50 nm and in particular not more than 30 nm. The size can be determined laser-optically as described above for the fillers. It is possible to use, for example, commercial silica products, e.g. silica sols such as the Levasils®, silica sols from Bayer AG, or pyrogenic silicas, e.g. the Aerosil products from Degussa, for this purpose. The particulate materials can be added in the form of powders and sols. However, they can also be formed in situ in the hydrolysis and polycondensation of the silanes.

In one embodiment, one or more additional hydrolyzable compounds which do not contain any silicon can be added in the hydrolysis and polycondensation of the silanes. The compound is preferably a boron or metal compound. When such hydrolyzable metal or boron compounds are used in the hydrolysis and condensation, the metal or boron is built into the matrix. The hydrolyzable compound preferably has the general formula (II)

$$MX_a \quad (II)$$

where M is a metal of main groups I to VIII or of transition groups II to VIII of the Periodic Table of the Elements or boron, X is defined as in formula (I), with two groups X being able to be replaced by an oxo group, and a corresponds to the valence of the element.

Examples of such compounds are compounds of glass- or ceramic-forming elements, in particular compounds of at least one element M from main groups III to V and/or transition groups II to IV of the Periodic Table of the Elements. They are preferably hydrolyzable compounds of Al, B, Sn, Ti, Zr, V or Zn, in particular those of Al, Ti or Zr, or mixtures of two or more of these elements. It is likewise possible to use, for example, hydrolyzable compounds of elements of main groups I and II of the Periodic Table (e.g. Na, K, Ca and Mg) and transition groups V to VIII of the Periodic Table (e.g. Mn, Cr, Fe and Ni). Hydrolyzable compounds of the lanthanides such as Ce can also be used. Preference is given to hydrolyzable compounds of the elements B, Ti, Zr and Al, with Ti being particularly preferred.

Preferred compounds are, for example, the alkoxides of B, Al, Zr and Ti. Suitable hydrolyzable compounds are, for example, $Al(OCH_3)_3$, $Al(OC_2H_5)_3$, $Al(O\text{-}n\text{-}C_3H_7)_3$, $Al(O\text{-}i\text{-}C_3H_7)_3$, $Al(O\text{-}n\text{-}C_4H_9)_3$, $Al(O\text{-}sec\text{-}C_4H_9)_3$, $AlCl_3$, $AlCl(OH)_2$, $Al(OC_2H_4OC_4H_9)_3$, $TiCl_4$, $Ti(OC_2H_5)_4$, $Ti(O\text{-}n\text{-}C_3H_7)_4$, $Ti(O\text{-}i\text{-}C_3H_7)_4$, $Ti(OC_4H_9)_4$, Ti(2-ethylhexoxy)$_4$, $ZrCl_4$, $Zr(OC_2H_5)_4$, $Zr(O\text{-}n\text{-}C_3H_7)_4$, $Zr(O\text{-}i\text{-}C_3H_7)_4$, $Zr(OC_4H_9)_4$, $ZrOCl_2$, Zr(2-ethylhexoxy)$_4$ and Zr compounds which have complexing radicals, e.g. β-diketone and (meth) acrylate radicals, sodium ethoxide, potassium acetate, boric acid, $BCl_3$, $B(OCH_3)_3$, $B(OC_2H_5)_3$, $SnCl_4$, $Sn(OCH_3)_4$, $Sn(OC_2H_5)_4$, $VOCl_3$ and $VO(OCH_3)_3$.

The hydrolysis and polycondensation of the silanes can be carried out in the presence or absence of an organic solvent. Preference is given to using no organic solvent. When an organic solvent is used, the starting components are preferably soluble in the reaction medium. Otherwise, the hydrolysis and polycondensation can be carried out according to the procedures with which those skilled in the art are familiar. Water is added for the hydrolysis and condensation. Water can also be added in excess, in which case part of the water may, if appropriate, be added only after at least partial hydrolysis and/or condensation has occurred.

Suitable organic solvents are, in particular, water-miscible solvents such as monohydric or polyhydric aliphatic alcohols such as methanol, ethanol, 1- or 2-propanol, glycols such as butyl glycols, ethers such as diethers, esters such as ethyl acetate, ketones, amides, sulfoxides and sulfones or mixtures thereof, e.g. a mixture of ethanol, isopropanol and butyl glycol. The use of high-boiling solvents is sometimes also advantageous; examples are polyethers such as triethylene glycol, diethylene glycol diethyl ether, ethylene glycol monobutyl ether and tetraethylene glycol dimethyl ether. These examples are also suitable for the uses of organic solvents mentioned below.

Regardless of whether a solvent has been added before the hydrolysis and condensation, an organic solvent or else water can be added after at least partial reaction, e.g. to adjust the viscosity or with the addition of the fillers or other additives. The coating composition obtained can thus comprise an organic solvent and/or water.

The abrasive fillers are preferably dispersed in this coating suspension or solution or the sol of the glass-forming matrix in order to form the coating composition. However, it is also possible to combine these fillers with the hydrolyzable compounds and carry out the hydrolysis and/or condensation in the presence of the fillers. The filler can, for example, be added directly as powder or as suspension or slurry in an organic solvent to the coating composition.

Apart from the abrasive fillers, the coating composition used according to the invention can contain the additives customary in the surface coatings industry, e.g. additives which control the rheology and the drying behavior, wetting agents and leveling agents, antifoams, surfactants, solvents, dyes and pigments, in particular color-imparting pigments or effect pigments. Commercial matting agents, e.g. microsize $SiO_2$ or ceramic powders, can also be added to obtain matt layers having antifingerprint properties. If matting agents, e.g. microsize $SiO_2$ or ceramic powders, are used, the hydrolysis and polycondensation of the silanes can be carried out in the presence of these. However, they can also be added later to the coating composition.

The coating composition can be applied by the customary wet-chemical coating techniques, e.g. dipping, casting, spin coating, spraying, roller application, painting, doctor blade coating or curtain coating. It is also possible to use, for example, printing processes such as screen printing.

The coating composition applied to the metallic surface is normally dried at room temperature or slightly elevated temperature, e.g. up to 100° C., in particular up to 80° C., before it is thermally densified to form a vitreous layer. The thermal densification can, if appropriate, also be effected by means of IR or laser radiation.

The densification temperatures can vary within a wide range and naturally also depend on the materials used. A person skilled in the art will known suitable ranges. The thermal densification is generally carried out at a temperature in the range from 300 to 800° C., preferably from 350 to 700° C. The thermal densification also burns out any organics present, either completely or to a desired, very small residual content, so that a vitreous, inorganic layer is obtained. The coating composition can, e.g. on stainless steel or steel surfaces, be converted into dense $SiO_2$ films even at relatively low temperatures, generally at or above 400° C.

The layers can be thermally densified either under a normal or oxidizing atmosphere or under protective gas or a reducing atmosphere or with addition of amounts of hydrogen. The thermal densification can also comprise two or more stages under different or successively changing conditions, which is in general also preferred. Thus, the thermal densification can burn out the organics in a first stage in an oxidizing atmosphere at relatively low temperatures and then be carried out to final densification in a second stage in an inert atmosphere at relatively high temperatures.

Thus, for example, densification can be carried out in the first stage in an oxygen-containing atmosphere, e.g. in air, or alternatively under reduced pressure, e.g. at a residual pressure of ≦15 mbar. The final temperature can be in the range from 100 to 500° C., preferably from 150 to 450° C., with the precise temperatures depending, inter alia, on the conditions selected and the desired further treatment.

In the densification in an oxygen-containing atmosphere, preference is given to using compressed air as process gas. Here, an amount of process gas corresponding to from 3 to 10 times the internal volume of the furnace is preferably introduced per hour, with the gauge pressure in the interior of the furnace being from about 1 to 10 mbar, preferably from 2 to 3 mbar. At the same time, the partial pressure of water vapor in the process gas can be adjusted during this process step by introducing water into the compressed air stream before it enters the furnace. In this way, the microporosity of the predensified and also the finally densified layer can be adjusted. To produce coatings which are to be fully densified at temperatures of from 450 to 500° C., preference is given, for example, to setting a relative atmospheric humidity of the process gas of from 50 to 100% (amount of water based on room temperature) at temperatures up to a range from 200 to 400° C., particularly preferably from 250 to 350° C. For the further densification process to the above-mentioned final temperature of from 450 to 500° C., the addition of water is stopped.

In the second heat treatment stage, further densification occurs to form a vitreous layer. The second heat treatment stage is preferably carried out to a final temperature in the range from 350 to 700° C., more preferably from 400 to 600° C. and particularly preferably from 450 to 560° C. These temperature ranges are also preferred when the densification is carried out in one step. The second stage is preferably carried out in an atmosphere which is low in oxygen or an oxygen-free atmosphere having only a very low oxygen content (≦0.5% by volume). It can be carried out, for example, under atmospheric pressure or under reduced pressure. As atmosphere which is low in oxygen, it is possible to use an inert gas such as nitrogen having a gauge pressure of from 1 to 10 mbar, preferably from 1 to 3 mbar.

It is also possible to use more than two densification stages. For example, it can be advantageous to follow the two above-mentioned stages by a further densification stage under reducing conditions, e.g. using an $H_2/N_2$ mixture. Further details regarding suitable densification stages and the respective conditions may also be found in DE-A-102004001097.

The thermal densification is generally carried out according to a controlled temperature program, with the temperature being increased at a particular rate to a maximum final temperature. The above-mentioned temperatures for the densification relate to this maximum final temperature. The residence times at the maximum temperatures in the densification stages are usually from 5 to 75 min and preferably from 20 to 65 min.

In this way, vitreous layers which have a very high scratch and abrasion resistance can be obtained on metallic surfaces. They also form a hermetically sealing layer which even at relatively high temperatures prevents or drastically reduces access of oxygen to the metallic surface and ensures excellent corrosion protection and additionally helps avoid soiling, e.g. by fingerprints, water, oil, grease, surfactants and dust. It is possible, for example, to obtain ultrahard coatings having an antifingerprint function.

If appropriate, one or more intermediate layers can be provided between the metal substrate and the composite layer, e.g. in order to improve the adhesion, to provide additional protection or to produce additional optical effects. In general, inorganic, vitreous layers are likewise used for this purpose. The intermediate layers can likewise be applied wet-chemically or by other processes such as CVD or PVD, and they can be densified separately or preferably together with the composite layer. As conditions for thermal densification, it is possible to use the conditions which have been described above for the composite layer, but, depending on the composition, other conditions may also be advantageous. The intermediate layers are usually also inorganic, vitreous layers, and in a preferred embodiment are also the layers containing alkaline earth metal silicate or alkali metal silicate which have been described for the composite layer.

In general, the intermediate layer or intermediate layers does not/do not contain abrasive fillers like the composite layer. However, they can contain other additives, depending on the purpose. Since the composite layer can be made transparent, it is possible, for example, to incorporate color pigments or effect pigments into the intermediate layer(s) in order to produce desired decorative effects. However, it is also possible to incorporate color pigments or effect pigments directly into the composite layer in order to achieve such decorative effects, with intermediate layers being able to be present or absent. If one or more intermediate layers are present in this case, this/these can also contain color or effect pigments if appropriate.

The metal substrate provided with the composite layer can be a semifinished part such as a plate, metal sheet, tube, rod or wire, a component or a finished product. It can be used for, for example, plants, tools, household appliances, electric components, machines, vehicle parts, in particular automobile components, production plants, façades, conveying tools, light switch covers, irons, telephone housings or parts thereof.

The coatings are particularly suitable for metal substrates such as metal housings of electronic instruments, metallic components for optical instruments, metallic parts of interiors and exteriors of vehicles, metallic components in machine and plant construction, engines, metallic components involved in medical instruments, metallic components of household appliances, other electric appliances, sports equipment, weapons, munitions and turbines, household equipment such as containers, knives, metallic façade components, metallic components of elevators, parts of conveying devices, metallic parts of furniture, garden equipment, agricultural machinery, mountings, engine components and production plants in general.

The invention is illustrated by the following examples which do not restrict the invention in any way.

EXAMPLES

Production of Super-Scratch-Resistant Coatings Having an Antifingerprint Function

Example 1

Super-Scratch-Resistant, Colorless Coating for Sand-Blasted Light Switch Covers Composed of Stainless Steel a) Coating Base (1) (Sodium Silicate Coating Sol)

25 ml (124.8 mmol) of methyltriethoxysilane (MTEOS) are stirred overnight (at least 12 hours) with 7 ml (31.4 mmol) of tetraethoxysilane (TEOS) and 0.8 g (20 mmol) of sodium hydroxide at room temperature until all of the sodium hydroxide has dissolved and a clear yellow solution is present.

3.2 ml (177.8 mmol) of water are then slowly added dropwise at room temperature, resulting in the solution becoming warm. After the addition of water is complete, the clear yellow solution is stirred at room temperature until it has cooled again and is subsequently filtered through a filter having a pore size of 0.8 μm.

b) Pigment Suspension (2):

A mixture of 50% by weight of Alusion $Al_2O_3$ (platelet-like α-alumina, particle size $d_{90}$=18 μm) in 2-propanol is homogenized for 15 minutes in a Dispermat with cooling at 20° C., and the content of the suspension is subsequently determined by evaporating a sample of the final product (solids content: 40.0% by weight).

c) Pigment Suspension (3):

A mixture of 50% by weight of F1000 $Al_2O_3$ (blasting alumina, crushed, particle size from 1 to 10 μm) in 2-propanol is homogenized for 10 minutes in a Dispermat with cooling, and the content of the suspension is subsequently determined by evaporating a sample of the end product (40.0% by weight).

d) Coating Composition (4)

To produce the coating composition (4), 0.9 kg of the coating base (1) is placed in a vessel, 100 g of ethylene glycol monobutyl ether are added and the mixture is stirred. While stirring, 30 g of pigment suspension (2) and 45 g pigment suspension (3) are added and the mixture is stirred for a further 20 minutes.

e) Coating

After filtration through a 100 μm filter screen, the coating composition (4) is sprayed onto the stainless steel parts which have been precleaned in a commercial alkaline cleaning bath to a wet film thickness of 11 μm in an industrial flat spraying plant and subsequently dried at room temperature for 15 minutes.

f) Hardening

Subsequent to coating, the coated parts are introduced into a evacuatable retort furnace, hardened in a first heating step at 200° C. in air and subsequently hardened in pure nitrogen at 500° C. for 1 hour. The hardened glass layer has a thickness of 4 μm.

Example 2

Super-Scratch-Resistant, Gold-Colored Pigmented Coating on Stainless Steel a) Topcoat (5)

To produce the topcoat (5), 0.9 kg of the coating base (1) from Example 1 is placed in a vessel, 100 g of ethylene glycol monobutyl ether are added and the composition is mixed. 30 g of pigment suspension (2) and 45 g of pigment suspension (3) from Example 1 are then added while stirring.

b) Coating Composition (6)

To produce the coating composition (6), 20 g of Iriodin 323 "Royal Gold" (particle size: 5-25 μm) and 10 g of Iriodin 120 (fine silver, particle size: 5-25 μm) are added a little at a time while stirring to 0.9 kg of coating base (1) from Example 1. 100 g of ethylene glycol monobutyl ether are subsequently added and the composition is mixed.

c) Coating

After filtration through a 100 μm filter screen, the coating composition (6) is sprayed onto the blasted stainless steel soles which had been pre-cleaned in distilled water to a wet film having a thickness of 7 μm in an industrial flat spraying unit and subsequently dried at room temperature for 15 minutes. In a subsequent second coating step in the same unit, a further coating is sprayed on using the topcoat (5) (wet film thickness: 7 μm) and likewise dried for 15 minutes.

d) Hardening

Subsequent to coating, the coated parts are introduced into a convection chamber furnace, hardened in a first heating step to 350° C. in air with controlled addition of water and subsequently hardened in dry air up to 475° C. for 1 hour. The hardened glass layer has a thickness of 6 μm.

3. Super-Scratch-Resistant, Red Coating on Stainless Steel a) Coating Composition (7)

To produce the coating composition (7), 0.9 kg of coating base (1) as per Example 1 is placed in a vessel, 100 g of ethylene glycol monobutyl ether are added and the composition is mixed. 30 g of pigment suspension (2) and 45 g of pigment suspension (3) as per Example 1 are then added while stirring. 30 g of Iriodin 4504 "Lavarot" (particle size: 5-25 μm) are subsequently added a little at a time while stirring.

b) Coating

After filtration through a 100 μm filter screen, the coating composition (7) is applied to the stainless steel parts which have been pre-cleaned in a commercial alkaline cleaning bath to a wet film of 12 μm in an industrial flat spraying unit and subsequently dried at room temperature for 15 minutes.

c) Hardening

Subsequent to coating, the coated parts are introduced into a convection chamber furnace and hardened in a three-stage program at 350° C. with addition of air and water vapor, subsequently at 500° C. in dry air for 1 hour and finally in a reducing atmosphere (95% $N_2$+5% $H_2$) at 400° C. for 1 hour. The hardened glass layer has a thickness of 5 μm.

Example 4

Super-Scratch-Resistant, Colorless Corrosion Protection Coating on Titanium a) Coating Composition (8)

To produce the coating composition (8), 0.67 kg of coating base (1) as per Example 1 is placed in a vessel, 0.33 kg of 2-propanol is added and the composition is mixed. 23 g of pigment suspension (2) and 35 g of pigment suspension (3) are then added while stirring and the mixture is stirred for a further 20 minutes.

b) Coating

After filtration through a 100 μm filter screen, a wet film of 8 μm is sprayed using coating composition (8) in an industrial robot coating unit onto the titanium substrates which have been pre-cleaned in an alkaline cleaning bath and is subsequently dried at room temperature for 15 minutes.

c) Hardening

Subsequent to coating, the coated parts are introduced into an evacuatable retort furnace, hardened in a first heating step up to 200° C. in air and subsequently hardened in pure nitrogen at 530° C. for 1 hour. The hardened glass layer has a thickness of 3 μm.

The composite layers of Examples 1 to 4 all have a very high scratch and abrasion resistance. They can thus not be damaged, for example, by scourers composed of polymer-bonded α-alumina.

What is claimed is:

1. A metal substrate having a composite layer thereon, wherein the layer is an ultrahard composite layer comprised of an inorganic, vitreous matrix which comprises abrasive filler having a Mohs hardness of at least 7 and comprising at least one platelet-shaped filler having a platelet thickness which is less than a thickness of the composite layer and at least one filler which is not platelet-shaped and has a diameter that is less than a thickness of the composite layer, a proportion of the abrasive filler in the composite layer being from 1% to 35% by weight, based on a total weight of the composite layer.

2. The metal substrate of claim 1, wherein the inorganic, vitreous matrix comprises at least one of an alkaline earth metal silicate and an alkali metal silicate.

3. The metal substrate of claim 1, wherein the abrasive filler comprises at least one substance selected from carbides, nitrides and borides of transition metals, natural and synthetic diamond, α-alumina, natural and synthetic precious stones, boron, boron nitride, boron carbide, silicon carbide, silicon nitride, and platelet-like $Al_2O_3$.

4. The metal substrate of claim 3, wherein the abrasive filler comprises at least one substance selected from α-alumina, silicon carbide and tungsten carbide.

5. The metal substrate of claim 1, wherein the diameter and the thickness of the filler particles are smaller than the thickness of the composite layer by a factor of at least 5.

6. The metal substrate of claim 1, wherein the thickness of the composite layer is not greater than 20 μm.

7. The metal substrate of claim 1, wherein the proportion of abrasive filler in the composite layer is from 1% to 10% by weight.

8. The metal substrate of claim 1, wherein one or more intermediate layers are arranged between the metal substrate and the ultrahard composite layer.

9. The metal substrate of claim 1, wherein at least one pigment selected from color-imparting pigments and effect pigments is present in the composite layer or in an intermediate layer arranged between the composite layer and the metal substrate.

10. An article which comprises the metal substrate of claim 1, wherein the article is selected from metal housings of electronic instruments, metallic components for optical instruments, metallic parts of interiors and exteriors of vehicles, metallic components in machine and plant construction, engines, metallic components involved in medical instruments, metallic components of household appliances, electric appliances, sports equipment, weapons, munitions and turbines, household equipment, metallic façade components, metallic components of elevators, parts of conveying devices, metallic parts of furniture, garden equipment, agricultural machinery, mountings, engine components, and production plants.

11. The metal substrate of claim 1, wherein the inorganic, vitreous matrix comprises at least one platelet-shaped abrasive filler having a platelet diameter of from about 3 to 7 μm.

12. The metal substrate of claim 1, wherein the at least one abrasive filler comprises platelet-shaped α-alumina.

13. The metal substrate of claim 1, wherein the thickness of the composite layer is not greater than 4 μm.

14. The metal substrate of claim 1, wherein the proportion of abrasive filler in the composite layer is from 1.5% to 3% by weight.

15. A process for producing a metal substrate having an ultrahard composite layer, wherein the process comprises applying a coating composition comprising at least one of a hydrolyzate and condensate of a hydrolyzable compound as glass-forming matrix precursor and abrasive filler having a Mohs hardness of at least 7 to a metal substrate and thermally densifying the coating composition to form the composite layer, the abrasive filler comprising at least one platelet-shaped filler having a platelet thickness which is less than a thickness of the composite layer and at least one filler which is not platelet-shaped and has a diameter that is less than a thickness of the composite layer and a proportion of the abrasive filler in the composite layer being from 1% to 35% by weight, based on a total weight of the composite layer.

16. The process of claim 15, wherein the at least one of a hydrolyzate and a condensate comprises a sol comprising at least one of an alkali metal silicate and an alkaline earth metal silicate.

17. The process of claim 16, wherein the sol is obtained by hydrolysis and condensation of one or more silanes of formula (I)

$$R_nSiX_{4-n} \quad (I)$$

wherein the groups X are identical or different and represent hydrolyzable groups or hydroxyl groups, the radicals R are identical or different and represent hydrogen, alkyl, alkenyl and alkynyl groups having up to 4 carbon atoms and aryl, aralkyl and alkaryl groups having from 6 to 10 carbon atoms, and n is 0, 1 or 2, with the proviso that at least one silane having n=1 or 2 is used, or oligomers derived therefrom, in the presence of at least one compound selected from oxides and hydroxides of alkali metals and alkaline earth metals.

18. The process of claim 15, wherein additional hydrolyzable compounds which do not contain Si are used in addition to the silanes of formula (I).

19. The process of claim 15, wherein nanosize $SiO_2$ particles are added before the hydrolysis and condensation.

20. The process of claim 15, wherein the alkali metal and/or alkaline earth metal oxides and/or hydroxides are used in such an amount that an atomic ratio of Si:alkali metal and/or alkaline earth metal is from 20:1 to 7:1.

21. The process of claim 15, wherein an average value of n in the starting silanes of formula (I) is from 0.2 to 1.5.

22. The process of claim 15, wherein the coating composition applied to the metal substrate is densified at a temperature of from 300° C. to 800° C.

* * * * *